US009702251B2

(12) United States Patent
Ojanen

(10) Patent No.: US 9,702,251 B2
(45) Date of Patent: Jul. 11, 2017

(54) CUTTING TOOL ASSEMBLY INCLUDING RETAINER SLEEVE WITH RETENTION MEMBER

(71) Applicant: Kennametal Inc., Latrobe, PA (US)

(72) Inventor: Randall Walter Ojanen, Bristol, TN (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 14/659,658

(22) Filed: Mar. 17, 2015

(65) Prior Publication Data

US 2016/0273356 A1 Sep. 22, 2016

(51) Int. Cl.
*E21C 35/197* (2006.01)

(52) U.S. Cl.
CPC ..... *E21C 35/197* (2013.01)

(58) Field of Classification Search
CPC ..... E21C 35/197; E21C 35/18; E21C 35/19
USPC ..... 299/102–104, 106–107, 110
See application file for complete search history.

(56) References Cited

U.S. PATENT DOCUMENTS 4,327,947 A * 5/1982 Bower, Jr. ..... E21C 35/197 279/19.7
4,484,783 A * 11/1984 Emmerich ..... E21C 35/197 175/354
4,728,153 A * 3/1988 Ojanen ..... E21C 35/197 299/107
4,743,069 A 5/1988 Ojanen
4,818,027 A 4/1989 Simon
4,844,550 A * 7/1989 Beebe ..... E21C 35/197 299/107
4,850,649 A 7/1989 Beach et al.
5,303,984 A 4/1994 Ojanen
5,503,463 A 4/1996 Ojanen
6,378,952 B1 4/2002 Moosmann et al.
7,300,114 B2 * 11/2007 Frear ..... E21C 35/197 299/102
7,413,257 B2 8/2008 Ojanen
8,573,707 B2 11/2013 Swope
2008/0308981 A1 * 12/2008 Exel ..... E21C 35/197 267/292
2012/0049608 A1 3/2012 Ritchey et al.
2014/0339882 A1 * 11/2014 Hall ..... E21C 35/197 299/106

* cited by examiner

*Primary Examiner* — Sunil Singh
(74) *Attorney, Agent, or Firm* — Ian K. Samways

(57) ABSTRACT

A cutting tool assembly includes a holder having a front face that defines a longitudinal bore extending at least partially through the holder, a cutting tool having a head portion, a shank portion and a collar portion therebetween all extending along a longitudinal axis of the cutting tool, a retainer sleeve substantially surrounding the shank portion and configured for being removably received in the longitudinal bore of the holder and an outwardly biasing retention member connected to the retainer sleeve and configured for cooperating with the longitudinal bore of the holder.

18 Claims, 5 Drawing Sheets

A-A 3-3
A-A 10
12
14
16
18
20
22
24
26
28
30
31
32
33
36
38
40
42
46
48
50
52
54

CUTTING TOOL ASSEMBLY INCLUDING RETAINER SLEEVE WITH RETENTION MEMBER

BACKGROUND OF THE INVENTION

The present invention relates to cutting tools and cutting tool assemblies used for mining and/or construction and, more particularly, relates to a retainer with a retention member for such cutting tools and cutting tool assemblies.

Rotatable cutting tools are used in conjunction with a machine used to break up (or cut) a substrate such as coal, rock, asphalt pavement, concrete or the like. In its very basic aspects, such a machine includes a driven member (e.g., a chain, a wheel or a drum), a holder (which also may be referred to as, for example, a block or tool holder or the like) mounted to the driven member, and a rotatable cutting tool rotatably held in the holder. It is the cutting tool that impinges the substrate so as to break it into pieces upon impact.

As known to those skilled in the art, the useful life of the holder is much longer than the useful life of the cutting tool. Each holder is intended to accommodate many changes of cutting tools before the holder must be changed. In order to reduce the wear between the holder and the cutting bit, a sleeve (which also may be referred to as, for example, a retention sleeve, retainer sleeve, retainer, wear sleeve or the like) may be used in conjunction with the cutting tool and the holder. The sleeve typically is positioned between the cutting tool and holder. The sleeve protects the holder from wear and is removably mounted in the holder. The assembly of such cutting tool arrangements is an important step and often difficult in view of, for example, small tolerances between the various components.

There has been identified a need for improved cutting tool assemblies and/or related components that overcome limitations, shortcomings and disadvantages of known cutting tool assemblies and/or related components.

SUMMARY OF THE INVENTION

In accordance with an aspect of the invention, a cutting tool assembly includes: a holder having a front face that defines a longitudinal bore extending at least partially through the holder; a cutting tool having a head portion, a shank portion and a collar portion therebetween all extending along a longitudinal axis of the cutting tool; a retainer sleeve substantially surrounding the shank portion and configured for being removably received in the longitudinal bore of the holder; and an outwardly biasing retention member connected to the retainer sleeve and configured for cooperating with the longitudinal bore of the holder.

In accordance with another aspect of the invention, a tool assembly for mounting in a bore of a holder, the tool assembly includes: a cutting tool having a head portion, a shank portion and a collar portion therebetween all extending along a longitudinal axis of the cutting tool; a retainer sleeve substantially surrounding the shank portion and configured for being removably received in the bore of the holder; and an outwardly biasing retention member connected to the retainer sleeve and configured for cooperating with the bore of the holder.

In accordance with another aspect of the invention, a retainer assembly for mounting on a cutting tool having a shank portion, includes: a generally cylindrical retainer sleeve configured for substantially surrounding the shank portion of the cutting tool; and an outwardly biasing retention member connected to the retainer sleeve, wherein the outwardly biasing retention member includes an elongated arcuate member having a first end connected to the retainer sleeve and an opposing second end that is movable between a first position where it is in a generally expanded state and a second position where it is in a generally compressed state.

These and other aspects of the present invention will be more fully understood following a review of this specification and drawings.

DETAILED DESCRIPTION

Figures 1, 2, 3, 4:
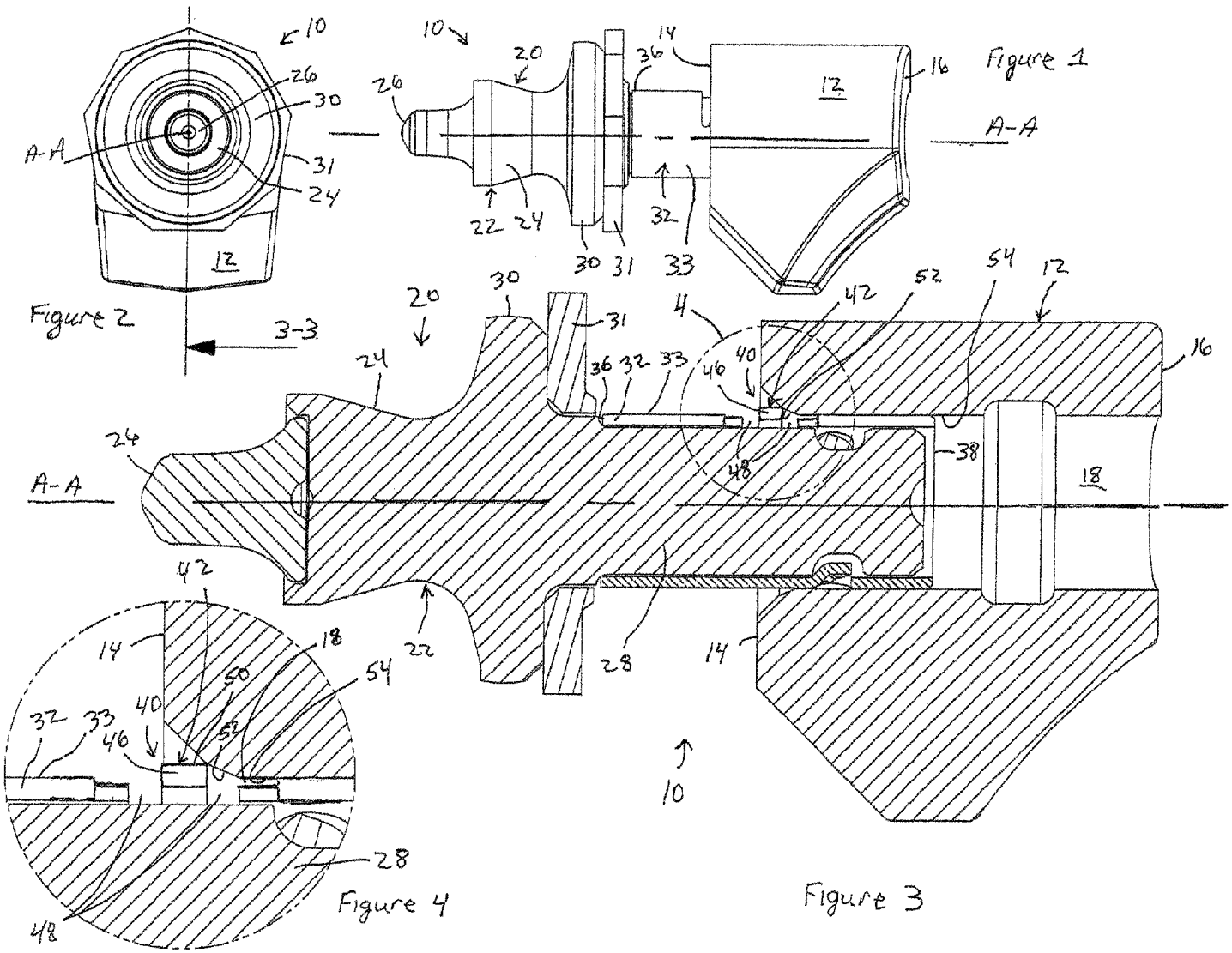
FIG. 1 is a side elevation view of a partially assembled cutting tool assembly, in accordance with an aspect of the invention.
FIG. 2 is a front view of the cutting tool assembly illustrated in FIG. 1, in accordance with an aspect of the invention.
FIG. 3 is a sectional view taken along line 3-3 of FIG. 2, in accordance with an aspect of the invention.
FIG. 4 is an enlarged view of area 4 of FIG. 3, in accordance with an aspect of the invention.

Referring to FIGS. 1-5, a cutting tool assembly 10 is shown. The tool assembly 10 includes a holder 12, which may also generally be referred to as a tool holder, holder portion, block, or the like. The holder 12 is affixed (such as by welding or the like) to a driven member, e.g., the drum of a road planning machine or a mining machine (not shown), as is generally known. The holder 12 includes a front face 14 and a rearward face 16. The holder 12 and the front face 14 thereof define a longitudinal bore 18 extending axially at least partially through the holder 12, e.g., extending at least partially between the front face 14 and the rear face 16. The holder 12 is configured to removably receive a tool assembly 20, which will now be explained in more detail.

The tool assembly 20 includes a cutting tool 22 such as, for example, a conical cutting tool. The cutting tool 22 includes a head portion 24 with a hard cutting tip 26, a shank portion 28 and a collar portion 30 therebetween, all disposed about a central longitudinal axis A-A of the cutting tool 22. A washer 31 may be positioned axially rearward of the collar portion 30 adjacent an axially forward end of the shank portion 28.

Figures 6, 7, 8:
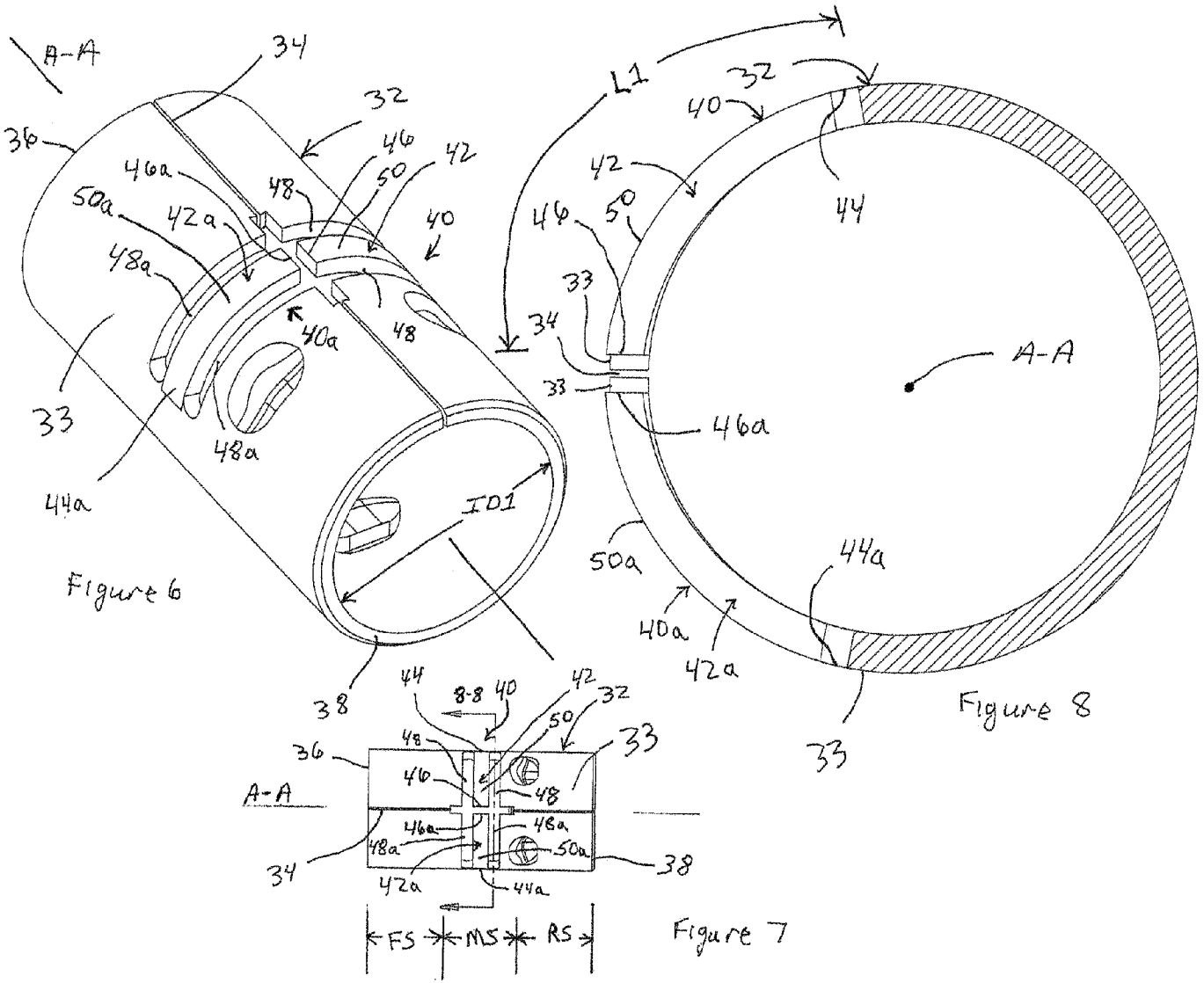
FIG. 6 is an isometric view of a retainer sleeve of the cutting tool assembly illustrated in FIGS. 1 and 3-5, in accordance with an aspect of the invention.
FIG. 7 is a top view of the retainer sleeve illustrated in FIG. 6, in accordance with an aspect of the invention.
FIG. 8 is a sectional view taken along line 8-8 of FIG. 7, in accordance with an aspect of the invention.

The tool assembly 20 also includes a retainer sleeve 32 (which also may be referred to as a retention sleeve, wear sleeve or the like) which is shown in more detail in FIGS. 6-8. In one aspect, the retainer sleeve 32 is generally cylindrical and includes an outer surface 33. In another aspect, the retainer sleeve defines a slot 34 that extends at least partially from an axial forward end 36 to an axial rearward end 38 of the retainer sleeve 32. Generally, the retainer sleeve 32 is configured to be placed on or about the shank portion 28 for insertion into the bore 18 of the holder 12 along with the shank portion 28. The retainer sleeve 32 is configured to be removably received in the bore 18.

In one aspect, the retainer sleeve 32 is configured to substantially surround the shank portion 28. In another aspect, the retainer sleeve 32 is formed of, for example, spring steel, and in conjunction with the slot 34, this provides for the retainer sleeve 32 to be resilient and/or expandable in order that it may be expanded to be installed on the shank portion. In one aspect, the retainer sleeve 32 can be easily fitted or positioned on or about the shank portion 28 for preparation of inserting the cutting tool 22 and, more specifically, the shank portion 28 thereof into the bore 18 of the holder 12. In one aspect, in its normal, uninstalled state the retainer sleeve 32 has an inner diameter ID1 (see, for example, FIG. 6) that is greater than a diameter D1 of the shank portion 28. In another aspect, the retainer sleeve 32 in its expanded, installed state has an outer diameter OD1 (see, for example, FIG. 5) that is smaller than a diameter D2 of the bore 18 such that the retainer sleeve 32 will fit in the bore 18.

The tool assembly 20 also includes an outwardly biasing retention member, generally designated as 40, connected to the retainer sleeve 32 and configured for cooperating with the longitudinal bore 18 of the holder 12. In one aspect, the outwardly biasing retention member 40 is compressible between a generally expanded state when not cooperating with the bore 18 of the holder 12 (see, for example, FIGS. 6 and 8) and a generally compressed state when cooperating with the bore 18 of the holder 12 (see, for example, FIG. 5).

Figure 5:
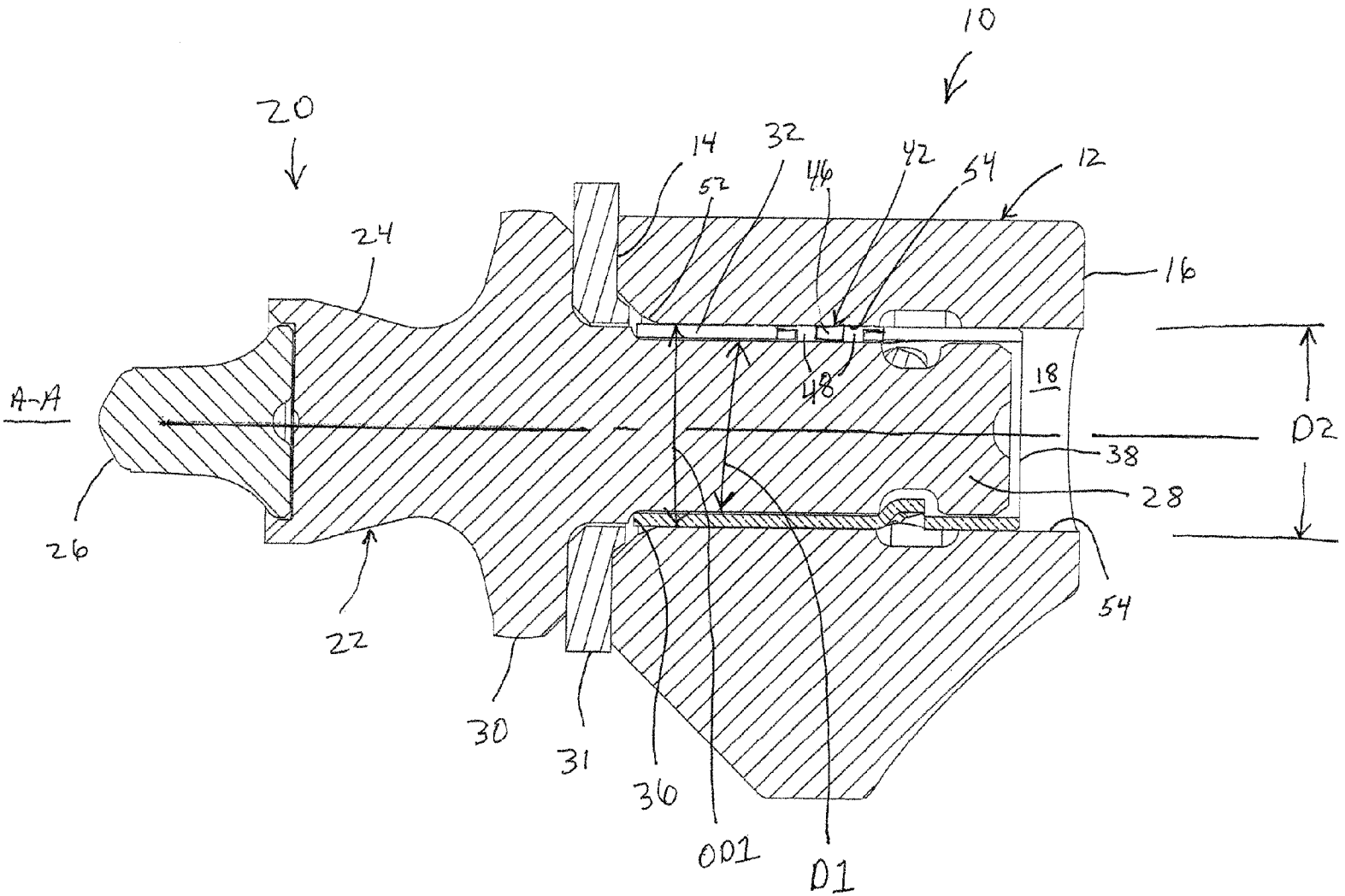
FIG. 5 is a sectional view similar to FIG. 3 but illustrating the cutting tool assembly fully assembled, in accordance with an aspect of the invention.

In another aspect of the invention, the outwardly biasing retention member 40 includes an elongated arcuate member 42 having a first end 44 connected to the retainer sleeve 32 and an opposing second end 46 that is movable between a first position where it is in a generally expanded state not cooperating with the bore 18 of the holder 12 (see, for example, FIGS. 6 and 8) and a second position where it is in a generally compressed state when cooperating with the bore 18 of the holder 12 (see, for example, FIG. 5). A pair of slots or openings 48 may be formed adjacent to, parallel to and/or alongside the elongated arcuate member 42 to provide for the resiliency and/or expandability of the elongated arcuate member 42.

In one aspect, at least a portion of the outwardly biasing retention member 40 and, in particular, at least a portion of the elongated arcuate member 42 in the first position extends circumferentially outward beyond the outer surface 33 of the retainer sleeve 32. In particular, the elongated arcuate member 42 includes an arcuate outer surface 50 having at least a portion thereof that extends circumferentially outward beyond the outer surface 33 of the retainer sleeve 32. As illustrated, for example, in FIG. 8, the elongated arcuate member 42 continues to progressively extend circumferentially more outward starting at the connected first end 44 towards the free second end 46 such that the outer surface 50 is circumferentially outward beyond the outer surface 33 of the retainer sleeve 32.

FIGS. 3 and 4 illustrate the tool assembly 20 being inserted partially into the bore 18 with the outwardly biasing retention member 40 and, in particular, at least a portion of the elongated arcuate member 42 in the first position or expanded state. As the tool assembly is then inserted further into the bore 18, the elongated arcuate member 42 and, in particular, the outer surface 50 engages a chamfer or slanted portion 52 at the axial forward end of the bore 18 such that the elongated arcuate member 42 then begins to compress. In one aspect, the arcuate outer surface 50 of the elongated member 42 of the outwardly biasing retention member 40 engages a wall 54 of the longitudinal bore 18 of the holder 12 when in the second position to retain the retainer sleeve 32 in the longitudinal bore 18 of the holder 12 (see, for example, FIG. 5). Thus, the arcuate outer surface 50 of the outwardly biasing retention member 40 is compressed and circumferentially aligned with the outer surface 33 of the retainer sleeve 32 when in the second position. The outwardly biased force provided by the arcuate outer surface 50 of the elongated member 42 against the wall 54 of the bore 18 which is what advantageously holds or retains the retainer sleeve 32 in the bore 18.

In accordance with another aspect of the invention, an additional outwardly biasing retention member **40*a* may be provided and also be connected to the retainer sleeve 32 and configured for cooperating with the longitudinal bore 18 of the holder 12. It will be appreciated that the additional outwardly biasing retention member 40*a* may be essentially the same as the outwardly biasing retention member 40, as described herein. For example, the additional outwardly biasing retention member 40*a* can include an elongated arcuate member 42*a* having a first end 44*a* connected to the retainer sleeve 32 and an opposing second end 46*a* that is movable between a first position where it is in a generally expanded state and a second position where it is in a generally compressed state. A pair of slots or openings 48*a* may be formed adjacent to, parallel to and/or alongside the elongated arcuate member 42*a* to provide for the resiliency and/or expandability of the elongated arcuate member 42*a***.

In one aspect, at least a portion of the outwardly biasing retention member **40*a* and, in particular, at least a portion of the elongated arcuate member 42*a* in the first position extends circumferentially outward beyond the outer surface 33 of the retainer sleeve 32. In particular, the elongated arcuate member 42*a* includes an arcuate outer surface 50*a* having at least a portion thereof that extends circumferentially outward beyond the outer surface 33 of the retainer sleeve 32. As illustrated, for example, in FIG. 8, the elongated arcuate member 42*a* continues to progressively extend circumferentially more outward starting at the connected first end 44*a* towards the free second end 46*a* such that the outer surface 50*a* is circumferentially outward beyond the outer surface 33 of the retainer sleeve 32**.

In another aspect, the second end 46 of the outwardly biasing retention member 40 is adjacent the second end **46*a* of the additional outwardly biasing retention member 40*a*. However, it will be appreciated that the positioning or orientation of the outwardly biasing retention member 40 relative to the positioning or orientation of the additional outwardly biasing retention member 40*a*** may be different than as illustrated.

In accordance with another aspect of the invention, the retainer sleeve 32 can be configured to include an axial forward section FS, an axial rearward section RS and an axial middle section MS therebetween, wherein the outwardly biasing retention members 40 and/or **40*a* are positioned on the axial middle section MS (see, for example, FIG. 7). In another aspect, the outwardly biasing retention members 40 and/or 40*a* are substantially positioned on the axial middle section MS. In another aspect, the axial middle section MS comprises a middle third portion of the retainer sleeve 32, i.e., the axial forward section FS is about ⅓ of the axial length of the retainer sleeve 32 as measured from the axial forward end 36 to the axial rearward end 38, the axial rearward section RS is about ⅓ of the axial length of the retainer sleeve 32 and the axial middle section MS is about ⅓ of the axial length of the retainer sleeve 32. However, it will be appreciated that the positioning or orientation of the outwardly biasing retention member 40 and/or the additional outwardly biasing retention member 40***a* relative to the length and/or dimension of the retainer sleeve 32 may be different than as illustrated, for example, the outwardly biasing retention members 40 and/or 40*a* may be positioned or substantially positioned on the axial middle section MS wherein the axial middle section MS may comprise a middle 50% of the retainer sleeve 32 etc. We have determined that most of the wear for the retainer sleeve 32 against the wall 54 of the bore 18 of the holder 12 occurs generally adjacent the axial forward end 36 and/or the axial rearward end 38 of the retainer sleeve 32. Advantageously, by positioning, orienting and/or configuring the outwardly biasing retention member 40 and/or the additional outwardly biasing retention member 40*a* as described and illustrated herein there is less wear on the outwardly biasing retention member 40 and/or the additional outwardly biasing retention member 40*a*. In addition, this configuration also requires less retention force to insert and/or retain the retainer sleeve in the bore 18.

In accordance with another aspect of the invention, an arc length L1 (see, for example, FIG. 8) of the elongated arcuate member 40 is in the range of about 8% to about 30% of an outer circumference of the retainer sleeve 32, i.e. about the outer surface 33 thereof. The additional elongated arcuate member 40*a* may be similarly configured. Advantageously, this allows for the outwardly biasing retention member 40 and/or the additional outwardly biasing retention member 40*a* to be designed or configured as needed to exert the necessary or desired amount of retention force against the wall 54 of the bore 18. It will be appreciated that other aspects, dimensions, shapes and/or orientations of outwardly biasing retention member 40 and/or the additional outwardly biasing retention member 40*a* may be designed or configured as needed to exert the necessary or desired amount of force against the wall 54 of the bore 18.

Figure 9:
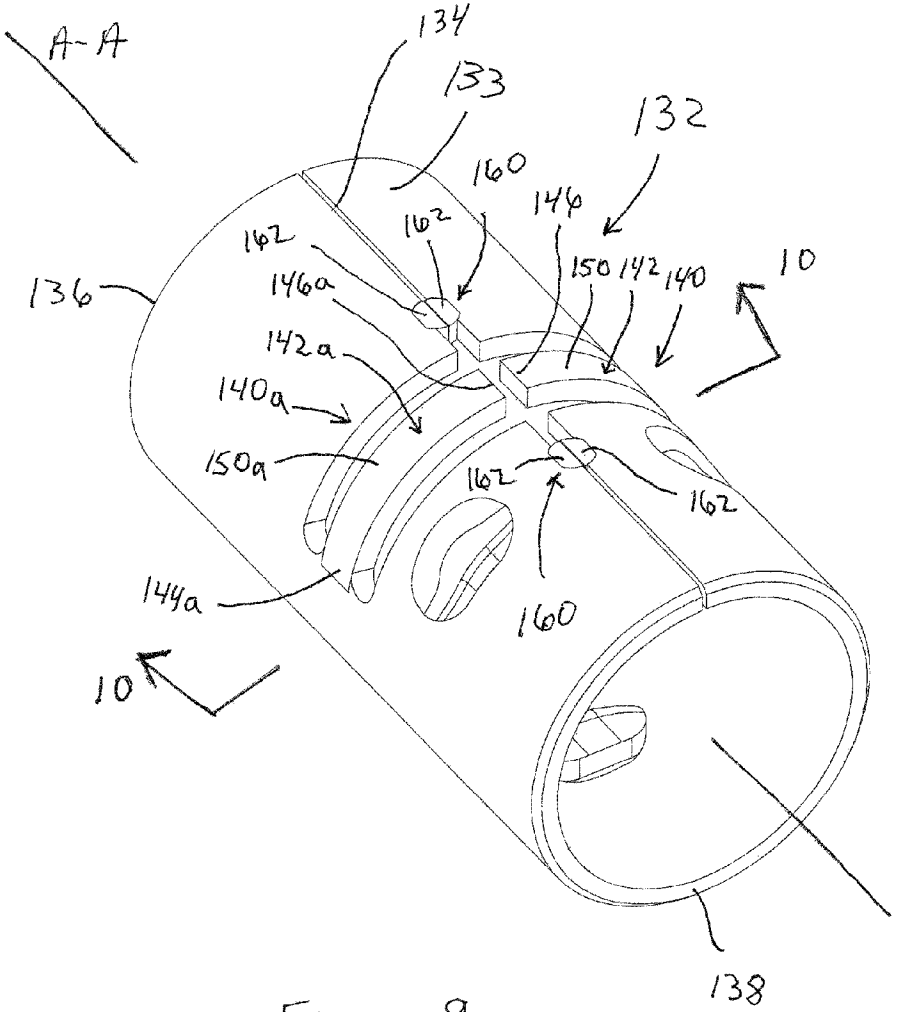
FIG. 9 is an isometric view of an additional retainer sleeve, in accordance with another aspect of the invention.
Figure 11:
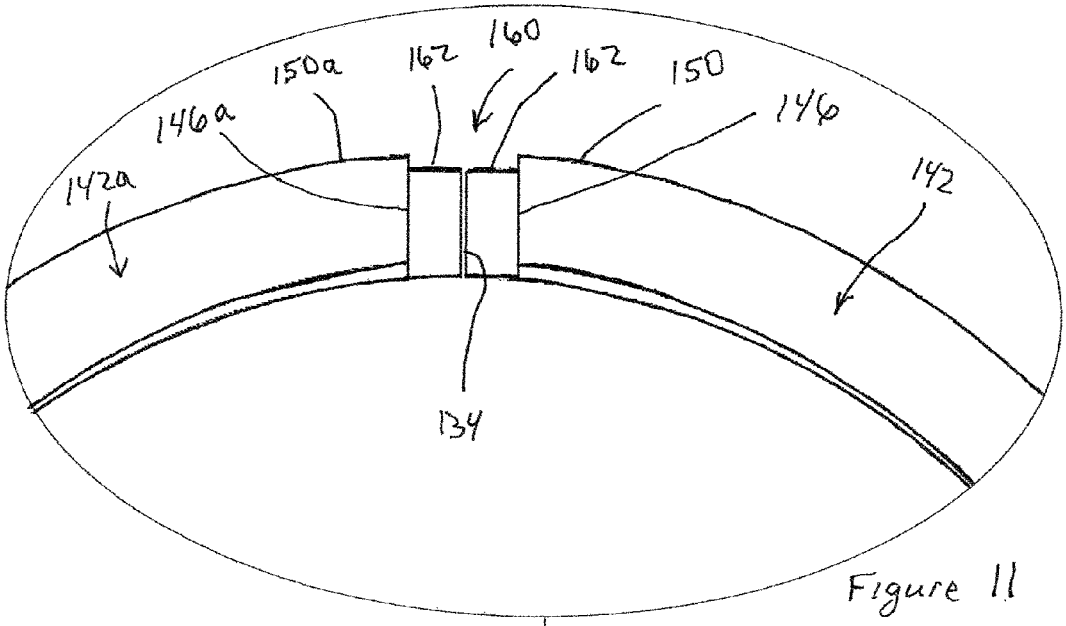
FIG. 11 is an enlarged view of area 11 of FIG. 10, in accordance with an aspect of the invention.
Figure 10:
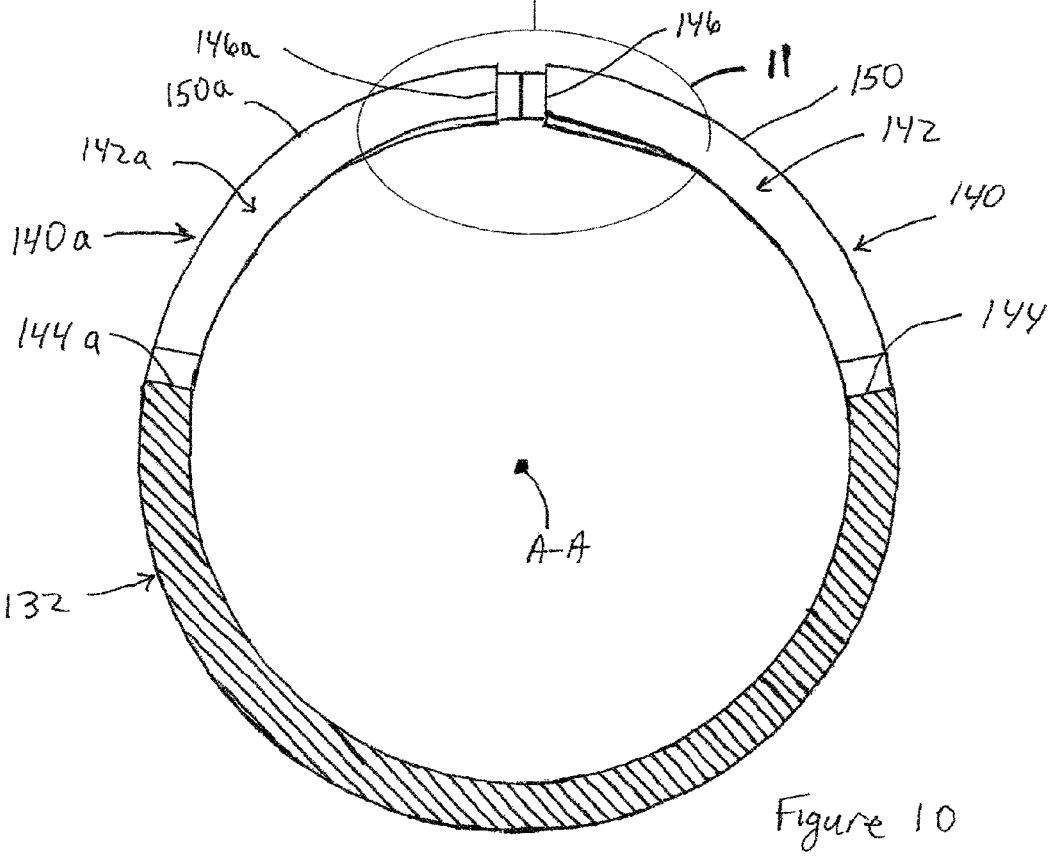
FIG. 10 is a sectional view taken along line 10-10 of FIG. 9, in accordance with an aspect of the invention.

Referring to FIGS. 9-11, there is illustrated an additional retainer sleeve 132, in accordance with another aspect of the invention. The retainer sleeve 132 is similar to retainer sleeve 32 as described and illustrated herein. For example, the retainer sleeve 132 is generally cylindrical and includes an outer surface 133. In another aspect, the retainer sleeve defines a slot 134 that extends at least partially from an axial forward end 136 to an axial rearward end 138 of the retainer sleeve 132. Generally, the retainer sleeve 132 is configured to be placed on or about the shank portion 28 for insertion into the bore 18 of the holder 12 along with the shank portion 28. The retainer sleeve 132 is configured to be removably received in the bore 18

In addition, one or more outwardly biasing retention members, generally designated as 140 and 140*a*, are connected to the retainer sleeve 132 and configured for cooperating with the longitudinal bore 18 of the holder 12. In one aspect, the outwardly biasing retention members 140 and 140*a* are compressible between a generally expanded state when not cooperating with the bore 18 of the holder 12 and a generally compressed state when cooperating with the bore 18 of the holder 12. Each outwardly biasing retention member 140, 140*a* includes an elongated arcuate member 142, 142*a* having a first end 144, 144*a* connected to the retainer sleeve 132 and an opposing second end 146, 146*a* that is movable between a first position where it is in a generally expanded state not cooperating with the bore 18 of the holder 12 and a second position where it is in a generally compressed state when cooperating with the bore 18 of the holder 12.

In one aspect, the retainer sleeve 132 includes one or more coin marks or flattened areas 160 provided during manufacturing and/or assembly of the retainer sleeve 132. Each flattened area 160 includes a top surface(s) 162 that is generally aligned with the outer surface 133. As best seen in FIG. 11, the slot 134 extends through the flattened areas 160.

In addition, at least a portion of each outwardly biasing retention member 140, 140*a* and, in particular, at least a portion of the elongated arcuate members 142, 142*a* in the first position extends circumferentially outward beyond the top surfaces 162 of the flattened areas 160 and the outer surface 133 of the retainer sleeve 132. In particular, the elongated arcuate members 142, 142*a* include an arcuate outer surface 150, 150*a* having at least a portion thereof that extends circumferentially outward beyond the top surfaces 162 and the outer surface 133 of the retainer sleeve 132. As illustrated, for example, in FIGS. 10 and 11, the elongated arcuate members 142, 142*a* continue to progressively extend circumferentially more outward starting at the connected first ends 144, 144*a* towards the free second ends 146, 146*a* such that the outer surfaces 150, 150*a* is circumferentially outward beyond top surfaces 162 of the flattened areas 160 and the outer surface 133 of the retainer sleeve 132.

Whereas particular aspects of this invention have been described above for purposes of illustration, it will be evident to those skilled in the art that numerous variations of the details of the present invention may be made without departing from the invention.

The invention claimed is:

1. A cutting tool assembly, comprising:

a holder having:

a front face; and a longitudinal bore that extends at least partially through the holder and opens at the front face;

a cutting tool having a head portion, a shank portion and a collar portion therebetween all extending along a longitudinal axis of the cutting tool;

a retainer sleeve substantially surrounding the shank portion and configured for being removably received in the longitudinal bore of the holder, the retainer sleeve extending along a longitudinal axis which is substantially parallel to the longitudinal axis of the cutting tool;

an outwardly biasing retention member connected to the retainer sleeve and configured for cooperating with the longitudinal bore of the holder;

wherein the outwardly biasing retention member includes an elongated arcuate member having a first end connected to the retainer sleeve and an opposing, free second end; and an additional outwardly biasing retention member connected to the retainer sleeve and configured for cooperating with the longitudinal bore of the holder;

wherein the additional outwardly biasing retention member includes an elongated arcuate member having a first end connected to the retainer sleeve and an opposing, free second end;

wherein the second end of the outwardly biasing retention member is oppositely facing and adjacent the second end of the additional outwardly biasing retention member when viewed in a plane transverse to the longitudinal axis of the retainer sleeve.

2. The cutting tool assembly of claim 1, wherein the elongated arcuate member is movable between:

a first position, where the elongated arcuate member is in a generally expanded state and is not cooperating with the longitudinal bore of the holder; and a second position, where the elongated arcuate member is in a generally compressed state and is cooperating with the longitudinal bore of the holder.

3. The cutting tool assembly of claim 2, wherein the retainer sleeve is generally cylindrical and includes an outer surface.

4. The cutting tool assembly of claim 3, wherein at least a portion of the outwardly biasing retention member, in the first position, extends radially outwardly beyond the outer surface of the retainer sleeve.

5. The cutting tool assembly of claim 4, wherein the elongated member of the outwardly biasing retention member includes an arcuate outer surface that engages a wall of the longitudinal bore of the holder when in the second position, to retain the retainer sleeve in the longitudinal bore of the holder.

6. The cutting tool assembly of claim 5, wherein the arcuate outer surface of the outwardly biasing retention member is circumferentially aligned with the outer surface of the retainer sleeve when in the second position.

7. The cutting tool assembly of claim 2, wherein an arc length of the elongated arcuate member is in the range of about 8% to about 30% of a circumference of the retainer sleeve.

8. The cutting tool assembly of claim 1, wherein the retainer sleeve includes an axial forward section, an axial rearward section and an axial middle section therebetween, the outwardly biasing retention member being positioned on the axial middle section.

9. The cutting tool assembly of claim 8, wherein the axial middle section comprises a middle third portion of the retainer sleeve.

10. The cutting tool assembly of claim 1, wherein the elongated arcuate member of the additional outwardly biasing retention member is movable between a first position where it is in a generally expanded state and a second position where it is in a generally compressed state.

11. The cutting tool assembly of claim 10, wherein:

the retainer sleeve defines a slot that extends at least partially from an axial forward end to an axial rearward end of the retainer sleeve, and substantially in parallel with respect to the longitudinal axis of the retainer sleeve; and the second end of the outwardly biasing retention member and the second end of the additional outwardly biasing retention member are separated via the slot, when the outwardly biasing retention member and the additional outwardly biasing retention member are each in a generally expanded state.

12. The cutting tool assembly of claim 1, wherein the elongated arcuate member extends along a circumferential direction of the retainer sleeve.

13. The cutting tool assembly of claim 12, further comprising a pair of slots formed adjacent to and on either side of the elongated arcuate member, and extending along a circumferential direction of the retainer sleeve.

14. A tool assembly for mounting in a bore of a holder, the tool assembly comprising:

a cutting tool having a head portion, a shank portion and a collar portion therebetween all extending along a longitudinal axis of the cutting tool;

a retainer sleeve substantially surrounding the shank portion and configured for being removably received in the bore of the holder, the retainer sleeve extending along a longitudinal axis which is substantially parallel to the longitudinal axis of the cutting tool;

an outwardly biasing retention member connected to the retainer sleeve and configured for cooperating with the bore of the holder;

wherein the outwardly biasing retention member includes an elongated arcuate member having a first end connected to the retainer sleeve and an opposing, free second end; and an additional outwardly biasing retention member connected to the retainer sleeve and configured for cooperating with the bore of the holder;

wherein the additional outwardly biasing retention member includes an elongated arcuate member having a first end connected to the retainer sleeve and an opposing, free second end;

wherein the second end of the outwardly biasing retention member is oppositely facing and adjacent the second end of the additional outwardly biasing retention member when viewed in a plane transverse to the longitudinal axis of the retainer sleeve.

15. A retainer assembly for mounting on a cutting tool having a shank portion, comprising:

a generally cylindrical retainer sleeve configured for substantially surrounding the shank portion of the cutting tool, the retainer sleeve extending along a longitudinal axis; and an outwardly biasing retention member connected to the retainer sleeve, wherein the outwardly biasing retention member includes an elongated arcuate member having a first end connected to the retainer sleeve and an opposing second, free end, the elongated arcuate member being movable between:

a first position, where the elongated arcuate member is in a generally expanded state; and a second position, where the elongated arcuate member is in a generally compressed state; and an additional outwardly biasing retention member connected to the retainer sleeve and configured for cooperating with a bore of a holder;

wherein the additional outwardly biasing retention member includes an elongated arcuate member having a first end connected to the retainer sleeve and an opposing, free second end;

wherein the second end of the outwardly biasing retention member is oppositely facing and adjacent the second end of the additional outwardly biasing retention member when viewed in a plane transverse to the longitudinal axis of the retainer sleeve.

16. The retainer assembly of claim 15, wherein:

at least a portion of the outwardly biasing retention member, in the first position, extends radially outwardly beyond an outer surface of the retainer sleeve; and wherein an arcuate outer surface of the outwardly biasing retention member is circumferentially aligned with the outer surface of the retainer sleeve when in the second position.

17. The retainer assembly of claim 16, wherein the retainer sleeve includes an axial forward section, an axial rearward section and an axial middle section therebetween, wherein the axial middle section comprises a middle third portion of the retainer sleeve, the outwardly biasing retention member being positioned on the axial middle section.

18. The retainer assembly of claim 17, wherein the elongated arcuate member of the additional outwardly biasing retention member is movable between a first position where it is in a generally expanded state and a second position where it is in a generally compressed state.

* * * * *